US011468874B2

(12) United States Patent
Sun et al.

(10) Patent No.: US 11,468,874 B2
(45) Date of Patent: Oct. 11, 2022

(54) NOISE CONTROL SYSTEM

(71) Applicant: Google LLC, Mountain View, CA (US)

(72) Inventors: Guohua Sun, Santa Clara, CA (US); Jae Lee, Palo Alto, CA (US); Tiantian Xu, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 33 days.

(21) Appl. No.: 17/097,616

(22) Filed: Nov. 13, 2020

(65) Prior Publication Data

US 2022/0157290 A1 May 19, 2022

(51) Int. Cl.
*H04R 1/10* (2006.01)
*G10K 11/178* (2006.01)

(52) U.S. Cl.
CPC .. *G10K 11/17854* (2018.01); *G10K 11/17881* (2018.01); *H04R 1/1016* (2013.01); *H04R 1/1083* (2013.01); *G10K 2210/1081* (2013.01); *G10K 2210/3026* (2013.01); *G10K 2210/3027* (2013.01); *G10K 2210/3028* (2013.01); *G10K 2210/3044* (2013.01); *G10K 2210/3224* (2013.01); *H04R 2460/01* (2013.01); *H04R 2460/11* (2013.01)

(58) Field of Classification Search
CPC ... G10K 2210/3026; G10K 2210/3027; G10K 2210/3028; G10K 2210/3044; G10K 2210/3224; H04R 2460/01; H04R 2460/11
USPC ..... 381/71.6
See application file for complete search history.

(56) References Cited

U.S. PATENT DOCUMENTS

| | | | | |
|---|---|---|---|---|
| 2011/0044464 | A1* | 2/2011 | Sapiejewski ..... | G10K 11/17881 381/71.7 |
| 2014/0169579 | A1* | 6/2014 | Azmi ..... | G10K 11/17827 381/71.6 |
| 2014/0311499 | A1* | 10/2014 | Lee ..... | G10K 11/17861 128/866 |
| 2015/0023515 | A1 | 1/2015 | Reimert | |
| 2015/0243271 | A1 | 8/2015 | Goldstein | |
| 2017/0208380 | A1* | 7/2017 | Slater ..... | H04R 1/1083 |
| 2018/0255394 | A1* | 9/2018 | Colich ..... | H04R 1/2823 |
| 2019/0304429 | A1 | 10/2019 | Gauger, Jr. et al. | |
| 2020/0066249 | A1 | 2/2020 | Christoph | |

* cited by examiner

*Primary Examiner* — Vivian C Chin
*Assistant Examiner* — Friedrich Fahnert
(74) *Attorney, Agent, or Firm* — Colby Nipper PLLC

(57) ABSTRACT

A hybrid ANC system that can allow a feedback microphone to receive the same external noise as a feedforward microphone. A processor can generate an anti-noise signal based on what both microphones received to cancel a broader range of frequencies of the external noise.

18 Claims, 5 Drawing Sheets

NOISE CONTROL SYSTEM

BACKGROUND

Noise control systems can include passive noise control (PNC) and active noise control (ANC) systems. PNC systems rely on the physical design of the sound system to block out noise external to the sound system, such as insulation, sound absorption material, and mufflers. ANC systems include the use of feedforward and feedback microphones to cancel the external noise through a speaker of the sound system emitting an anti-noise signal. The anti-noise signal is determined based on the external noise received in feedforward microphones or feedback microphones. Feedforward microphones receive noise external to the sound system, such as outside the housing for an earbud, while feedback microphones receive external noise near the exit point of the system, such as near a user's ear in an earbud.

Hybrid ANC systems use both feedforward and feedback microphones to improve the range of noise being canceled. Such systems have been widely implemented in earbuds to provide more noise cancellation in the lower frequency range, advantageously complementing PNC systems. In such examples, the feedforward microphone will receive noise external to the housing while the PNC system minimizes the amount of external noise entering the housing so that the feedback microphone receives any residual noise. The speakers emit an anti-noise signal canceling the external noise from the feedforward microphone and the residual noise from the feedback microphone.

Such hybrid ANC systems are limited in their coverage of the external noise. For instance, where the noise control system is in an earbud, a first anti-noise signal based off the feedforward microphone may be unable to cancel out the external noise that may have penetrated the earbud due to the changed characteristics of that external noise after entering the earbud. Meanwhile, a second anti-noise signal based off the feedback microphone may be unable to cover some of that same external noise, such as the higher frequencies, as the location of the feedback microphone leaves less processing time for the second anti-noise signal to be created, thus allowing only for certain frequencies to be canceled by the second anti-noise signal.

BRIEF SUMMARY

This disclosure is directed to a hybrid ANC system that can allow a feedback microphone to receive the same external noise as a feedforward microphone. A processor can generate an anti-noise signal based on what both microphones received to cancel a broader range of frequencies of the external noise.

One aspect of the disclosure provides for an earbud comprising a housing defining a duct extending from an interior portion of the housing to outside of the housing, the duct including a passive noise control component configured to allow external noise into the housing with a time delay, a feedforward microphone configured to receive the external noise, a front portion of the feedforward microphone facing outside the housing, a feedback microphone in communication with the duct, the feedback microphone being configured to receive the external noise with the time delay, and a speaker in electrical communication with the feedforward microphone and the feedback microphone, the speaker configured to emit a filtered noise signal based on the external noise received by the feedforward microphone and the external noise received by the feedback microphone with the time delay. The earbud may further comprise a second feedforward microphone and a second feedback microphone. A rear portion of the speaker may be received in the duct. The duct may not be in communication with the feedforward microphone. The passive noise control component may comprise one of sound-absorbing or sound-insulating materials. The housing may define a first compartment and a second compartment, a rear portion of the feedforward microphone being in the first compartment, the feedback microphone being in the second compartment. The housing may define a front vent extending from the second compartment to outside of the housing. The housing may further define a third compartment between the first compartment and the second compartment. The housing may further define a rear vent extending from the third compartment to outside of the housing. The housing may define a divide in the interior portion of the housing between the second compartment and the third compartment. The duct may go through the divide. The earbud may further comprise a memory, and one or more processors in communication with the feedforward microphone, the feedback microphone, and the memory, the one or more processors configured to receive, with the feedforward microphone at a first time, external noise outside of the housing of the earbud, generate, with the one or more processors, a first anti-noise signal based on the external noise received by the feedforward microphone, emit, with the speaker, the first anti-noise signal, receive, with the feedback microphone at a second time, the external noise and the first anti-noise signal, the second time being after the first time, generate, with one or more processors, the filtered anti-noise signal based on the first anti-noise signal and the external noise received by the feedback microphone at the second time, and emit, with the speaker, the filtered anti-noise signal.

Another aspect of the disclosure can provide for a method comprising receiving, with a feedforward microphone at a first time, external noise outside of a housing of an earbud, generating, with the one or more processors, a first anti-noise signal based on the external noise received by the feedforward microphone, emitting, with a speaker, the first anti-noise signal, receiving, with a feedback microphone at a second time, the external noise and the first anti-noise signal, the second time being after the first time, generating, with one or more processors, a filtered anti-noise signal based on the first anti-noise signal and the external noise received by the feedback microphone at the second time, and emitting, with the speaker, the filtered anti-noise signal. The housing may define a duct and the external noise received by the feedback microphone is received through the duct. At the second time, the feedback microphone may receive the external noise having a lower amplitude than the external noise received by the feedforward microphone at the first time. The method may further comprise comparing the external noise received from the feedback microphone and the first anti-noise signal to determine whether the first anti-noise signal covers a frequency range of the external noise.

Another aspect of the disclosure can provide for a non-transitory computer-readable medium housed in a computing device storing instructions, which when executed by one or more processors, cause the one or more processors to receive, with a feedforward microphone at a first time, external noise outside of a housing of a earbud, generate, with the one or more processors, a first anti-noise signal based on the external noise received by the feedforward microphone, emitting, with a speaker, the first anti-noise signal, receiving, with a feedback microphone at a second time, the external noise and the first anti-noise signal, the second time being after the first time, generating, with one or more processors, a filtered anti-noise signal based on the first anti-noise signal and the external noise received by the feedback microphone at the second time, and emitting, with the speaker, the filtered anti-noise signal. The housing may define a duct and the external noise received by the feedback microphone at the second time passes through the duct. At the second time, the feedback microphone may receive the external noise having a lower amplitude than the external noise received by the feedforward microphone at the first time. The non-transitory computer-readable medium may further comprise comparing the external noise received from the feedback microphone and the first anti-noise signal to determine whether the first anti-noise signal covers a frequency range of the external noise.

DETAILED DESCRIPTION

This technology is directed to a hybrid ANC system that can allow a feedback microphone to receive the same external noise as a feedforward microphone. The feedback microphone can receive the same external noise with a time delay from when the feedforward microphone. This time delay can be calibrated to match the time it takes for the feedforward microphone to send the audio information of the external noise to the system's processor, the processor to generate a first anti-noise signal based off that external noise, the processor to instruct a speaker to emit that first anti-noise signal, and for the speaker to emit that first anti-noise signal for the feedback microphone to receive. In this manner, the feedback microphone can receive the external noise the feedforward microphone first heard at substantially the same time as the anti-noise signal that was generated based on the external noise the feedforward microphone heard. The processor can use this information received by the feedback microphone to generate a filtered anti-noise signal that can provide a broad frequency coverage of the external noise.

Figure 1:
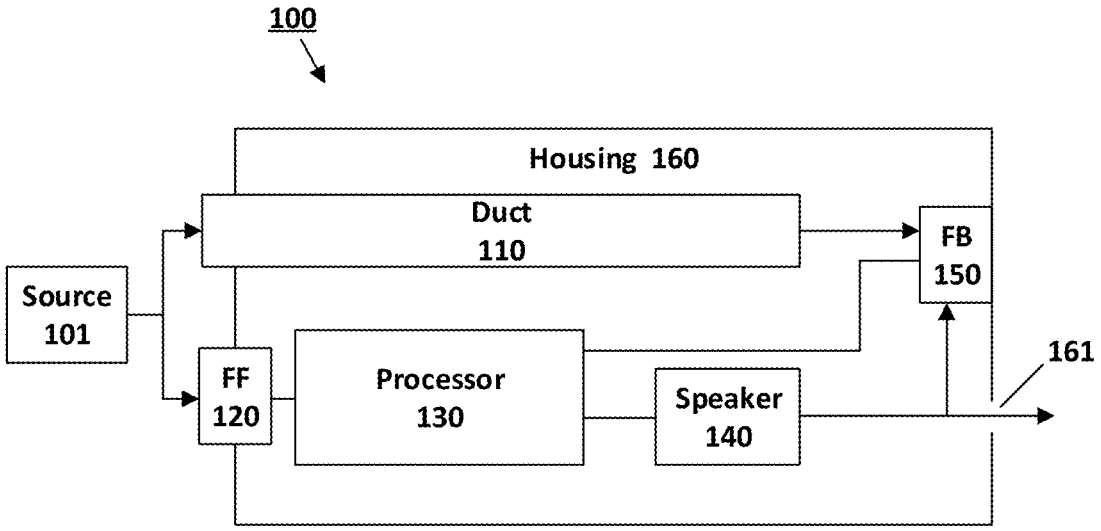
FIG. 1 is a schematic illustration of an example device in accordance with aspects of the disclosure.

FIG. 1 depicts a schematic illustration of a hybrid ANC system for device 100 having a housing 160 that contains the various components of the device, including duct 110, feedforward microphone 120, computing system 130, speaker 140, and feedback microphone 150. Source 101 can be any noise or audio information external to housing 160, including ambient noise or the like. Device 100 can be a headphone, earbud, or the like. Although not shown, device 100 can be in communication with a host device, such as a mobile phone, tablet, smart watch, or the like. The host device can provide device 100 with instructions to output certain sounds, such as music, podcasts, or the like.

Feedforward microphone 120, feedback microphone 150, and speaker 140 are in electrical communication with computing system 130. As described further below in FIG. 4, this electrical communication can enable computing system 130 to analyze noise received by feedforward microphone 120 and feedback microphone 150 while also providing instructions to speaker 140 to emit audio information, such as to emit an anti-noise signal and sounds. Feedforward microphone 120 is housed along a surface of housing 160 and faces away from the housing. Feedforward microphone 120 can receive external noise directly from source 101. Feedback microphone 150 is housed within housing 160 and faces an interior portion of the housing. As discussed further below, feedback microphone 150 can receive external noise from source 101 through duct 110, audio information from speaker 140, and other residual noise within housing 160.

Housing 160 defines duct 110 as a passage extending between feedback microphone 150 to outside the housing. Duct 110 can allow for communication between the environment outside housing 160 and feedback microphone 150. In this manner, noise from source 101 can enter housing 160 and travel through duct 160 so that feedback microphone 150 can receive the external noise. Duct 110 is sized so that the amplitude of the external noise entering the duct is only a fraction of the amplitude of external noise received by feedforward microphone 120. If duct 110 is too large, housing 160 may receive too much external noise and overpower the noise-canceling properties of device 100.

Duct 110 can be made out of a variety of PNC components, such as sound-absorbing, sound-insulating materials, or other passive noise control components known in the art. The PNC components can assist in slowing down the speed that external noise travels through duct 110 as well as further reducing the amplitude of the external noise leaving the duct. This reduction in speed can enable feedback microphone 150 to receive the external noise from source 101 along duct 110 with a time delay from when feedforward microphone 120 received the external noise. Specifically, the time delay can cause feedback microphone 150 to receive the external noise at substantially the same time as receiving output noise from speaker 140, such as an anti-noise signal based off the same external noise from when feedforward microphone 120 received it. As such, the PNC components of duct 110 can be precisely calibrated with a certain number and type of PNC components so that the time it takes for the external noise to travel through duct 110 and to be received by feedback microphone 150 is substantially equal to the time it takes for external noise to be sent from feedforward microphone 120 to computing system 130, for computing system 130 to generate a first anti-noise signal countering the external noise, send instructions to speaker 140 to emit the first anti-noise signal, and for the speaker to emit the first anti-noise signal for the feedback microphone to receive.

Housing 160 defines an exit opening 161 leading from an interior of the housing to the exterior of the housing. As such, exit opening 161 can allow for output noise from speaker 140 to exit device 100. For example, where device 100 is an earbud, exit opening 161 can allow for output noise to enter a user's ear from speaker 140. Feedback microphone 150 is placed close to exit opening 161. This location of feedback microphone 150 allows any noise that leaves exit opening 161 to also be received by the feedback microphone so that computing system 130 can receive information that most accurately replicates what noise might be leaving device 100, such as to a user's ear.

Figure 2:
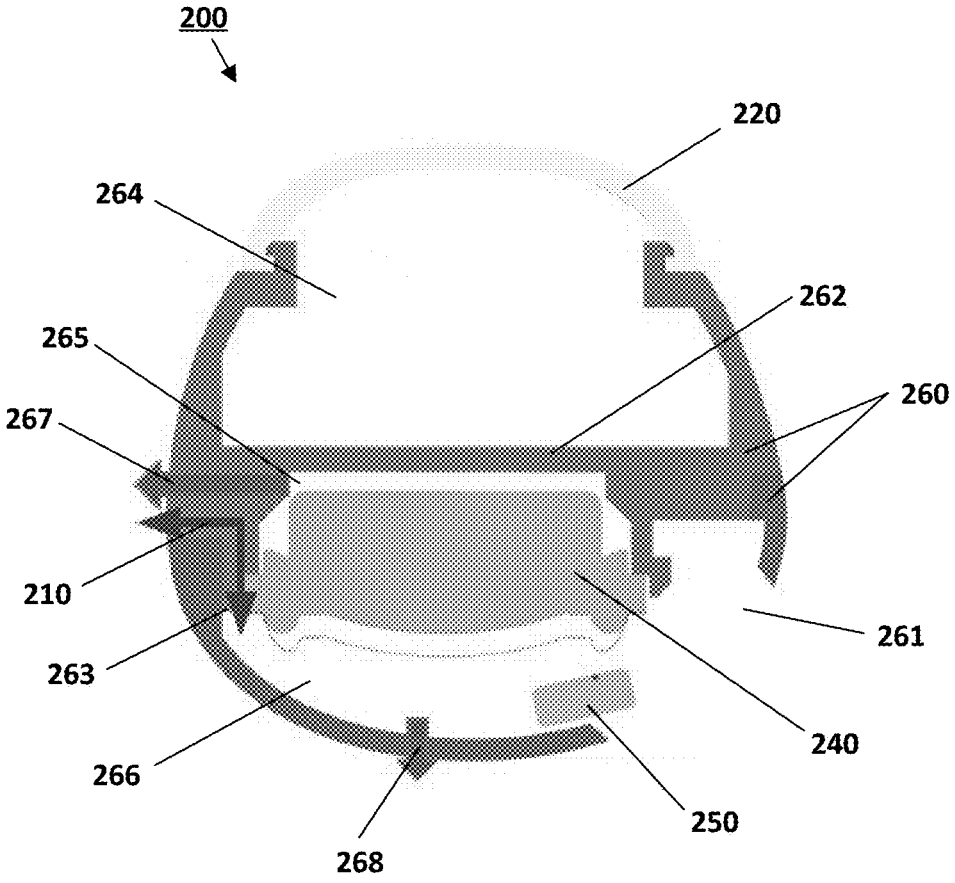
FIG. 2 is a cross-sectional view an example device in accordance with aspects of the disclosure.

In one example, FIG. 2 depicts device 200 having housing 260 and defining rear compartment 264, intermediate compartment 265, and front compartment 266. Feedforward microphone 220, speaker 240, and feedback microphone 250 are similar to feedforward microphone 120, speaker 140, and feedback microphone 150, as described above.

Rear compartment 264 is defined by housing 260 and feedforward microphone 220. Feedforward microphone 220 is attached housing 260 such that a portion of feedforward microphone 220 is outside the housing and facing away from the housing. In this manner, feedforward microphone 220 can directly receive noise external to housing 260 and forms a part of the exterior surface of device 200. Although feedforward microphone 220 is in electrical communication with other electronic components of device 200, such as a computing system (not shown), housing 260 defines a barrier 262 preventing physical communication between rear compartment 264 and compartments 265, 266. Barrier 262 can include or be made out of PNC components. This can prevent or mitigate the external noise from directly affecting other components of device 200, such as feedback microphone 250.

Intermediate compartment 265 is defined by housing 260 and a rear portion of speaker 240 between rear compartment 264 and front compartment 266. A rear portion of speaker 240 faces intermediate compartment 265 while a front portion of the speaker faces a front compartment 266. Housing 260 defines a divide 263 between front compartment 266 and intermediate compartment 265. Divide 263 and speaker 240 can both form a separation between front compartment 266 and intermediate compartment 265 such that noise from the intermediate compartment does not bleed into the front compartment. Housing 260 defines rear vent 267 extending from intermediate compartment 265 to outside the housing. Rear vent 267 can allow for air that is moved by the rear portion of speaker 240 to escape outside rather than being compressed and trapped in intermediate compartment 265. This can ensure that the air moved by speaker 240 is not trapped within intermediate compartment 265 and can help modulate certain sound qualities of the noise emitted by speaker 240 within the intermediate compartment, such as bass levels or the like.

Front compartment 266 is defined by housing 260 and a front portion of speaker 240. Housing 260 defines front vent 268 extending from front compartment 266 to outside the housing. Similar to rear vent 267, front vent 268 can allow for air moved by the front portion of speaker 240 to escape outside so that certain sound qualities can be modulated within front compartment 266.

Housing 260 defines duct 210 as a non-linear passage extending between front compartment 266 and external to the housing. Duct 210 can allow noise external to housing 260 to enter front compartment 266, through divide 263, and be received by feedback microphone 250. As discussed above, duct 210 is sized to allow a relatively small amplitude of external noise into front compartment 266 compared to the external noise that feedforward microphone 220 receives. Further, duct 210 includes or is made of PNC components to slow down the external noise entering front compartment 266 and feedback microphone 250.

Feedback microphone 250 is housed within front compartment 266 and placed adjacent exit opening 261. As discussed above, this placement of feedback microphone 250 can most accurately capture the noise that exits device 200 so that, in an earbud or headphone, a computing system can better analyze what a user may be hearing. Further, since front compartment 266 is substantially isolated from rear compartment 264 and intermediate compartment 265 by barrier 262 and divide 263, along with any PNC components between the front compartment and the rest of housing 260, the amount of other noise received by feedback microphone other than the external noise from duct 210 and the noise emitted by speaker 240 can be minimized.

Figure 3:
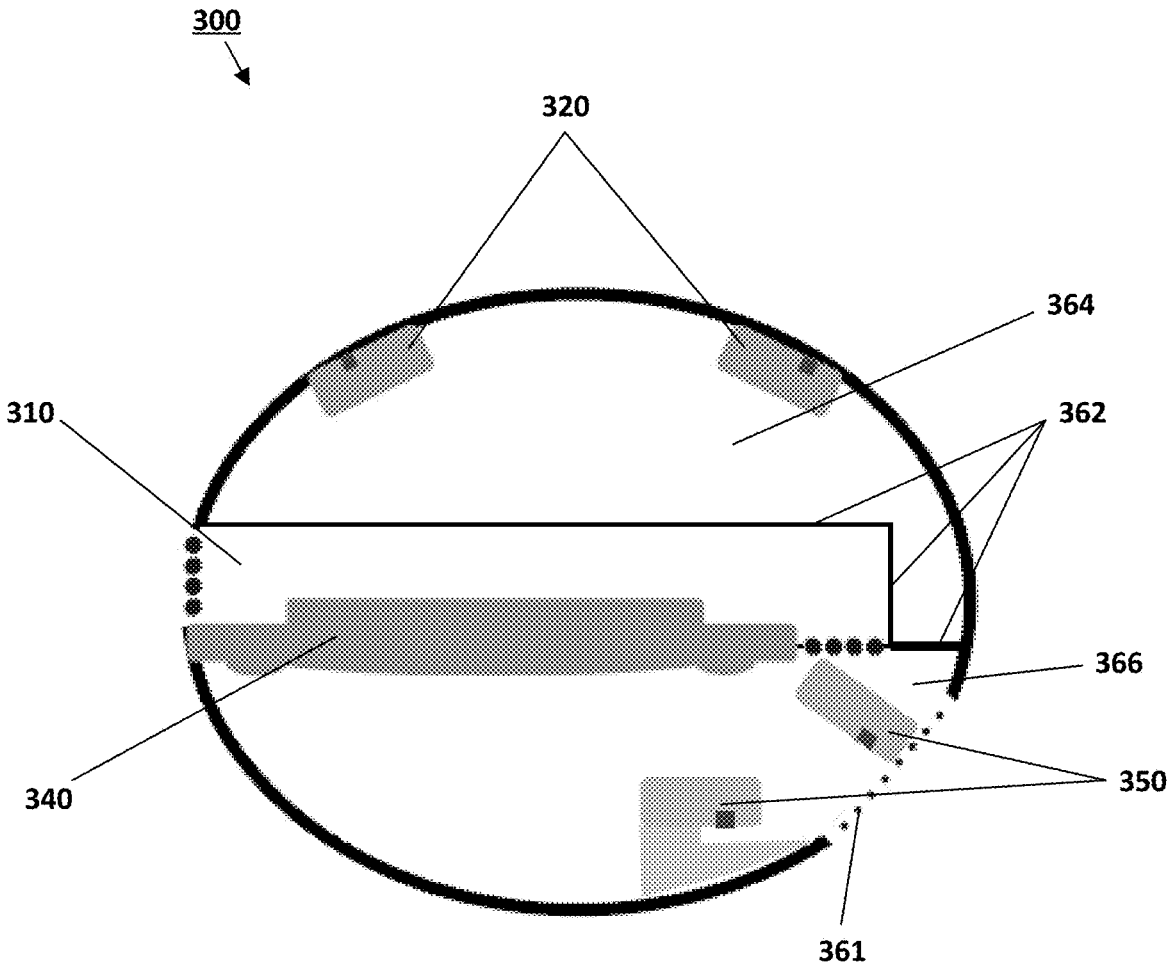
FIG. 3 is a cross-sectional view an example device in accordance with aspects of the disclosure.

In another example, FIG. 3 depicts device 300 having rear compartment 364, front compartment 366, and speaker 340, as described above for device 200. In this example, there are two feedforward microphones 320 and two feedback microphones 350. Duct 310 can be similar to duct 210 of device 200 except duct 310 is a linear passage and sized to be larger than duct 210. The size of duct 310 is configured to allow for external noise to come into device 300 as well as for air to escape out of housing 360 through the duct. This allows for external noise to flow directly through duct 310 to feedback microphones 350 behind speaker 340 and can replace a separate intermediate compartment, such as intermediate compartment 265 of device 200. Further, this allows duct 310 to act as a rear vent and front vent. With duct 310 replacing such features, the manufacturing of device 300 can be made more efficient and less complex while still providing the benefits of the duct allowing for external noise to enter feedback microphones 350, as discussed further below.

In other examples, there may be more than two feedforward and feedback microphones, such as three, four, or the like. In a yet further example, there may be one feedforward microphone and more than one feedback microphone, or vice versa. In a further example, there may be only one rear vent or only one front vent. For instance, the housing may define an intermediate compartment behind the speaker, and the duct can act as a rear vent for that intermediate compartment, while a front compartment can still separately define a front vent. Alternatively, the duct can act as a front vent while the housing separately defines a rear vent.

Figure 4:
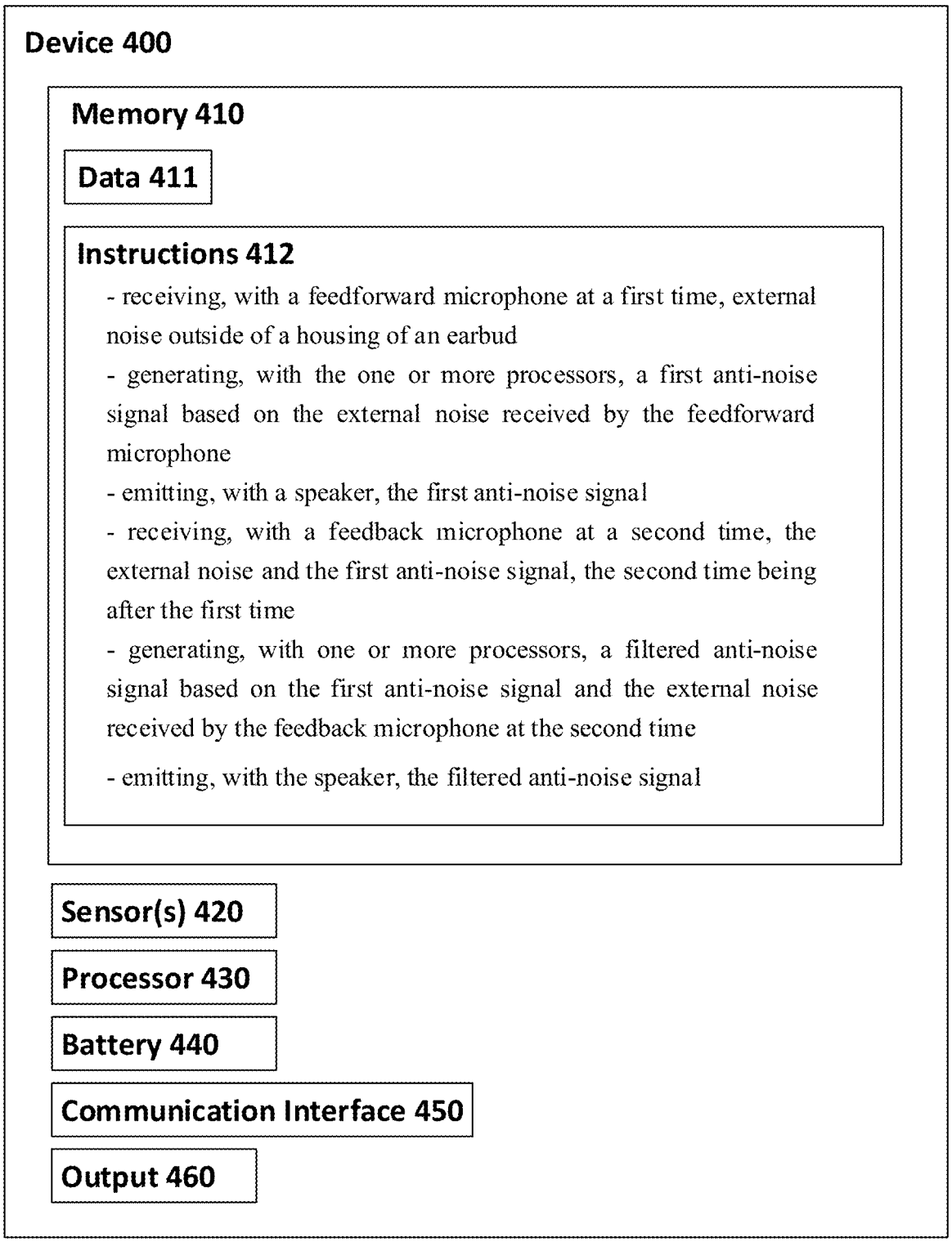
FIG. 4 is a functional block diagram depicting an example computing device in accordance with aspects of the disclosure.

FIG. 4 illustrates an example of internal components of a computing device 400, such as device 100, 200, 300. While a number of internal components are shown, it should be understood that additional or fewer components may be included. By way of example only, device 400 may include components typically found in playback devices such as speakers, microphones, earbuds, headphones, or the like. The computing device may be, for example, a wireless accessory, such as wireless earbuds, headphones, or the like. Moreover, the computing device may be a paired device in a system of other devices, such as a mobile phone or another earbud. While the below description relates to device 400, it should be understood that other devices in communication with device 400 may be similar or identical. In some examples, however, each device in the system of paired devices (e.g., an earbud and a mobile phone) may be a different type of device, or have different internal components. Device 400 may include one or more memories 410, sensors 420, processors 430, a battery 440, a communication interface 450, output 460, as well as other components.

Memory 410 may store information accessible by the one or more processors 430, including data 411 and instructions 412 that may be executed or otherwise used by the one or more processors 430. For example, memory 410 may be of any type capable of storing information accessible by the processor(s) 420, including a computing device-readable medium, or other medium that stores data that may be read with the aid of an electronic device, such as a volatile memory, non-volatile as well as other write-capable and read-only memories. By way of example only, memory 410 may be a static random-access memory (SRAM) configured to provide fast lookups. Systems and methods may include different combinations of the foregoing, whereby different portions of the instructions and data are stored on different types of media.

The data 411 may be retrieved, stored or modified by the one or more processors 430 in accordance with the instructions 412. Data 411 may also include information stored from sensor(s) 420. For instance, data 411 may include information received from one of sensor(s) 420. As one example, this can be in the form of audio readings from a microphone, such as microphones 120, 150, 220, 250, 320, 350. Although the claimed subject matter is not limited by any particular data structure, the data may be stored in computing device registers, in a relational database as a table having a plurality of different fields and records, XML documents or flat files. The data may also be formatted in any computing device-readable format.

The instructions 412 may be any set of instructions to be executed directly (such as machine code) or indirectly (such as scripts) by the one or more processors 430. For example, the instructions may be stored as computing device code on the computing device-readable medium. In that regard, the terms "software," "instructions," and "programs" may be used interchangeably herein. The instructions may be stored in object code format for direct processing by the processor 430, or in any other computing device language including scripts or collections of independent source code modules that are interpreted on demand or compiled in advance. For example, one sensor 420, such as a feedforward microphone, can receive, at a first time, external noise outside of device 400. Processor 430 can generate a first anti-noise signal based on the external noise received by the feedforward microphone and instruct output 460, such as a speaker, to emit that first anti-noise signal. Another sensor 420, such as a feedback microphone, can receive, at a second time after the first time, the external noise and the first anti-noise signal. Processor 430 can then generate a filtered anti-noise signal based on the first anti-noise signal and the external noise received by the feedback microphone. Processor 430 can then instruct the speaker to emit the filtered anti-noise signal. Further, memory 410 may house a machine-learning model that is trained and stored in the memory prior to a user first using device 400. Functions, methods and routines of the instructions are explained in more detail below.

Output 460 may be speakers, a display, a vibration element, or any other means of providing information to a user. For example, output 460 may be speakers 140, 240, 340.

The one or more processors 430 may be microprocessors, logic circuitry (e.g., logic gates, flip-flops, etc.) hard-wired into the device 400 itself, or may be a dedicated application specific integrated circuit (ASIC). It should be understood that the one or more processors 430 are not limited to hard-wired logic circuitry, but may also include any commercially available processing unit, or any hardware-based processors, such as a field programmable gate array (FPGA). In some examples, the one or more processors 430 may include a state machine or a digital signal processor (DSP) for a microphone. Each component within device 400 can have their own processor in communication with processor 430. For instance, sensors 420 and communication interface 450 may also have processors (not shown), similar to processor 430, to communicate with processor 430. Further, processors within sensors 420 and communication interface 450 may execute instructions (not shown) to perform a method similar to instructions 412.

The one or more sensors 420 may include any of a variety of mechanical or electromechanical sensors for detecting inputs or conditions relevant to other operations. Such sensors may include, for example, an accelerometer, gyroscope, switch, light sensor, barometer, audio sensor (e.g., microphones 120, 150, 220, 250, 320, 350), vibration sensor, heat sensor, radio frequency (RF) sensor, inertial measurement unit (IMU), motion sensor (such as a short range radar), capacitive sensor, resistive sensor, capacitance gasket, or the like. Sensor 420 may be powered by battery 440 onboard device 400 or may include its own battery (not shown). Where sensor 420 is powered by its own battery, the sensor may be on even when device 400 is not turned on.

The communication interface 450 may be used to form connections with other devices, such as a paired host device or another earbud. The connection may be, for example, a Bluetooth connection or any other type of wireless link. By way of example only, connections with other devices may include an asynchronous connection-less (ACL) link. The communication interface 450 may also be used to form a backchannel communication link with another wirelessly paired device. For example, where the device 400 is an earbud, the primary device may form a backchannel communication link with another earbud. Further device 400 can form a communication link with a host device, such as a mobile phone. This backchannel link may include a Bluetooth link, such as BLE, an NFMI link, or other types of links. Communication interface 450 may include a wireless communication controller, such as a Bluetooth controller, in communication with processor 430. The controller may be configured to execute instructions, such as a stack program, stored within communication interface 450 or memory 410 to provide a connection status between device 400 and other paired devices to processor 430.

Although FIG. 4 functionally illustrates the processor, memory, and other elements of device 400 as being within the same block, it will be understood by those of ordinary skill in the art that the processor and memory may actually include multiple processors and memories that may or may not be stored within the same physical housing. For example, memory 410 may be a volatile memory or other type of memory located in a casing different from that of computing device 110. Moreover, the various components described above may be components of one or more electronic devices.

Figure 5:
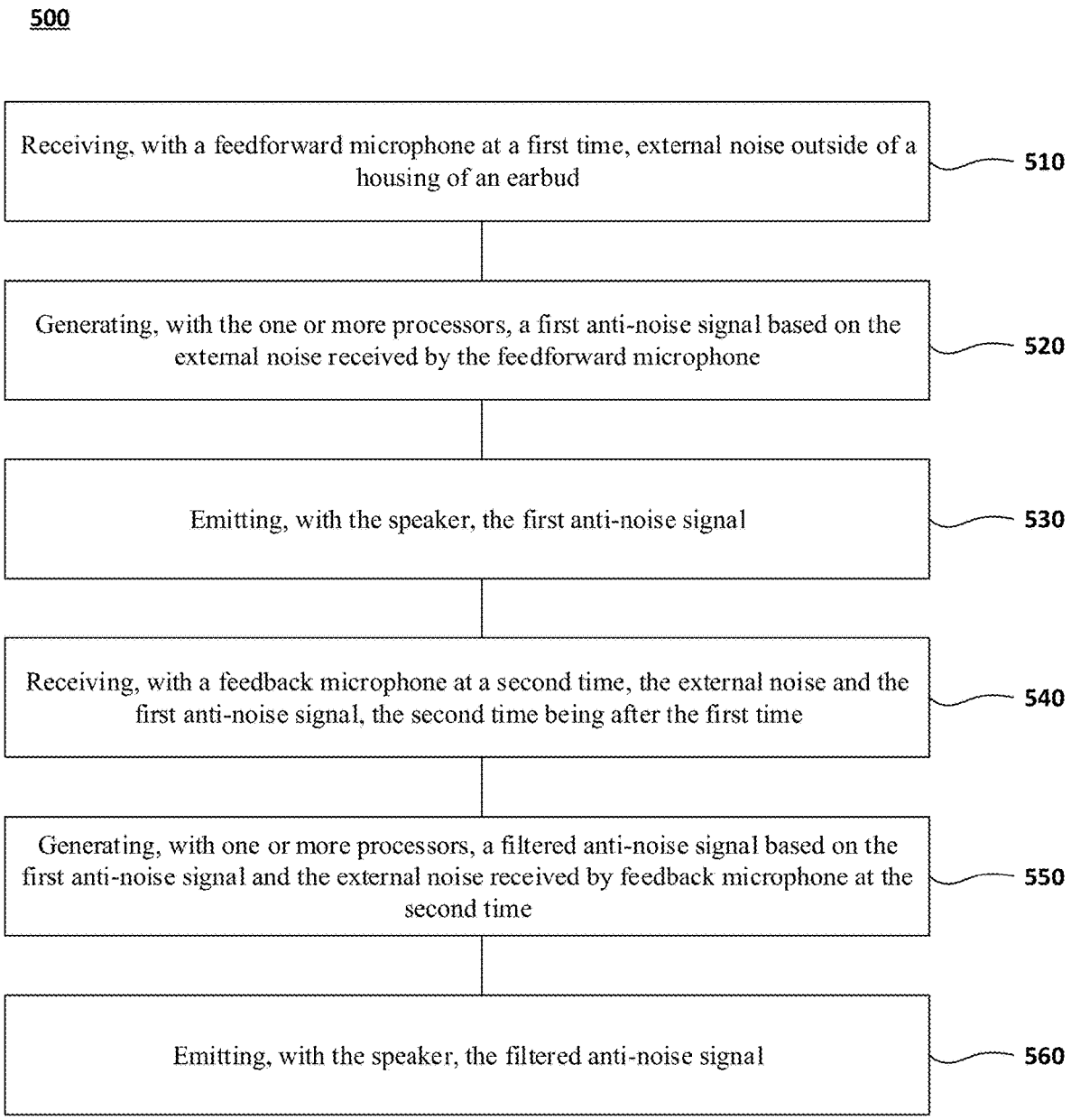
FIG. 5 an example flowchart of the method of use of a device in accordance with aspects of the disclosure.

With reference to device 100, 200, 300 of FIGS. 1-4 and flowchart 500 depicted in FIG. 5, a method of use will now be described. Turning to block 510, feedforward microphone 120, 220, 320 receives external noise outside of housing 160, 260, 360 at the first time. For example, with reference to FIG. 1, the external noise can be ambient noise or audio information from outside of housing 160, 260, 360, such as from source 101. As feedforward microphone 120, 220, 320 is secured by housing 160, 260, 360 facing outside, the feedforward microphone can receive audio information of external noise that is just outside device 100, 200, 300, 400. Further, since feedforward microphone 120, 220, 320 is housed within rear compartment 264, 364 and is separated from the rest of housing 160, 260, 360 by barrier 262, 362 and divide 263, a minimal amount of external noise, if any, bleeds into the rest of the housing.

Feedforward microphone 120, 220, 320 can send this audio information of the external noise to processor 130, 430. Turning to block 520, processor 130, 430 can generate a first anti-noise signal based on the external noise. This first anti-noise signal is a sound wave of the same amplitude of the external noise received by feedforward microphone 120, 220, 320 except with an inverted phase. This anti-noise signal can cancel out at least a portion of the external noise received by feedforward microphone 120, 220, 320.

Turning to block 530, processor 130, 430 can instruct speaker 140, 240, 340 to emit the first anti-noise signal into front compartment 266, 366. The first anti-noise signal can travel from speaker 140, 240, 340, through front compartment 266, 366, and out of exit opening 161, 261, 361. In this manner, the first anti-noise signal can assist in mitigating any external noise that might still be flowing out of device 100, 200, 300 through exit opening 161, 261, 361, such as to a user's ear where the device is an earbud. As discussed further below, feedback microphone 150, 250, 350 can also receive the first anti-noise signal as it travels through front compartment 266, 366.

However, some portion of the external noise will likely make its way into device 100, 200, 300, 400 no matter what precautions are taken and the first anti-noise signal may not be able to completely cancel out the entire frequency range of this external noise as heard near exit opening 161, 261, 361. This can be due to certain characteristics of the external noise being changed while within housing 160, 260, 360 that are not captured by the first anti-noise signal. As such, processor 130, 430 comparing external noise that is heard outside of housing 160, 260, 360 at a first time with the audio information of that external noise from that same time within the housing can help the processor generate a better anti-noise signal to cancel out the entire frequency range of the external noise.

Duct 110, 210, 310 can assist in providing such audio information by letting a controlled amount of external noise within housing 16, 260, 360 at substantially the same time that feedforward microphone 120, 220, 320 receives the external noise. However, the external noise received by duct 110, 210, 310 is slowed down by PNC components that are included or make up the duct. As such, the external noise exits duct 110, 210, 310 from outside of housing 160, 260, 360 within front compartment 166, 266, with a time delay, at a second time after the first time. Moreover, the PNC components of duct 110, 210, 310 also further reduces the amplitude of the external noise as it exits the duct.

Turning to block 540, feedback microphone 150, 250, 350 receives the first anti-noise signal and external noise at the second time, as well as other residual noise (if any) within housing 160, 260, 360 near exit opening 161, 261, 361. Feedback microphone 150, 250, 350 can receive the external noise from duct 110, 210, 310. The external noise leaving duct 110, 210, 310 into front compartment 266, 366 is at a reduced amplitude and with a time delay from when the external noise entered the duct and compared to when feedforward microphone 120, 220, 320 received the external noise. As discussed further below, feedback microphone 150, 250, 350 receiving the same external noise that feedforward microphone 120, 220, 320 received, albeit at a reduced amplitude, can assist in processor 130, 430 generating a filtered anti-noise signal that better covers the frequency range of the external noise both outside device 100, 200, 300, 400 and inside the device.

This temporal alignment requires that the external noise be delayed from being received by feedback microphone 150, 250, 350 until the external noise from feedforward microphone 120, 220, 320 is processed by processor 130, 430 to generate a first anti-noise signal, the processor instructs speaker 140, 240, 340 to emit the first anti-noise signal, and the speakers emit the first-anti-noise signal into front compartment 266, 366 for the feedback microphone to receive. The time delay of the external noise entering duct 110, 210, 310 can be calibrated by changing the opening area and/or length of the duct as well as the number and/or type of PNC components of the duct.

Once feedback microphone 150, 250, 350 receives the external noise from duct 110, 210, 310 and the first anti-noise signal at substantially the same time, the feedback microphone can send this audio information to processor 130, 430. Turning to block 550, processor 130, 430 can generate a filtered anti-noise signal based on the first anti-noise signal and the external noise received by feedback microphone 150, 250, 350 at the second time. The filtered anti-noise signal is configured to cancel out at least some of the noise received by feedback microphone 150, 250, 350. Specifically, this filtered anti-noise signal can cover both the range of frequencies covered by the first anti-noise signal as well as some of the frequencies of the external noise that the first anti-noise signal could not cover.

In generating the filtered noise signal, processor 130, 430 can compare the external noise that feedforward microphone 120, 220, 320 heard at the first time (through the first anti-noise signal based off that external noise) as well as the external noise that feedback microphone 150, 250, 350 heard from that same time. Based on the comparison, the processor 130, 430 may determine what portions of the external noise was not completely canceled out by the first anti-noise signal near exit opening 161, 261, 361 and to generate the filtered anti-noise signal to cover those portions.

Turning to block 560, processor 130, 430 can instruct speaker 140, 240, 340 to emit the filtered anti-noise signal. Speaker 140, 240, 340 can emit this signal through front compartment 266, 366 to exit opening 161, 261, 361. Moreover, speakers 140, 240, 340 can emit audio in addition to the filtered anti-noise signal, such as music or the like.

Current hybrid ANC systems can provide better noise canceling coverage than the use of just a feedforward microphone or feedback microphone. However, such systems are still limited in the frequencies for which they can provide noise cancellation. For example, while current hybrid ANC systems in earbuds can cancel some of the noise external to that earbud in providing audio to the earbud's user, there are still portions of that external noise that the current systems cannot cancel.

The noise control system of this disclosure can cancel a broader range of frequencies of external noise than modern ANC systems. This can be due to the feedback microphone receiving the same external noise, albeit at a lower amplitude, than the feedforward microphone receives. Specifically, the feedback microphone receives the external noise at the same time as receiving the first anti-noise signal that was generated based on that external noise received by the feedforward microphone. The system of this disclosure can compare the external noise received by the feedback microphone with the first anti-noise signal to generate a more holistic anti-noise signal that better cancels out external noise prior to a user hearing the audio.

Although the subject matter herein has been described with reference to particular examples, it is to be understood that these examples are merely illustrative of the principles and applications of the subject matter described. It is therefore to be understood that numerous modifications may be made and that other arrangements may be devised without departing from the spirit and scope as defined by the appended claims.

The invention claimed is:

1. An earbud, comprising:

a housing defining a duct extending from an interior portion of the housing to outside of the housing, the duct including a passive noise control component configured to allow external noise into the housing while imparting a time delay to the external noise allowed into the housing;

a feedforward microphone configured to receive the external noise, a front portion of the feedforward microphone facing outside the housing;

a feedback microphone in communication with the duct, the feedback microphone being configured to receive the external noise with the time delay; and a speaker in electrical communication with the feedforward microphone and the feedback microphone, the speaker configured to emit a filtered noise signal based on the external noise received by the feedforward microphone and the external noise received by the feedback microphone with the time delay.

2. The earbud of claim 1, further comprising a second feedforward microphone and a second feedback microphone.

3. The earbud of claim 1, wherein a rear portion of the speaker is received in the duct.

4. The earbud of claim 1, wherein the duct is not in communication with the feedforward microphone.

5. The earbud of claim 1, wherein the passive noise control component can comprise one of sound-absorbing or sound-insulating materials.

6. The earbud of claim 1, wherein the housing defines a first compartment and a second compartment, a rear portion of the feedforward microphone being in the first compartment, the feedback microphone being in the second compartment.

7. The earbud of claim 6, wherein the housing defines a front vent extending from the second compartment to outside of the housing.

8. The earbud of claim 6, wherein the housing further defines a third compartment between the first compartment and the second compartment.

9. The earbud of claim 8, wherein the housing further defines a rear vent extending from the third compartment to outside of the housing.

10. The earbud of claim 8, wherein the housing defines a divide in the interior portion of the housing between the second compartment and the third compartment.

11. The earbud of claim 10, wherein the duct goes through the divide.

12. The earbud of claim 1, further comprising:

a memory; and one or more processors in communication with the feedforward microphone, the feedback microphone, and the memory, the one or more processors configured to:

receive, with the feedforward microphone at a first time, external noise outside of the housing of the earbud;

generate, with the one or more processors, a first anti-noise signal based on the external noise received by the feedforward microphone;

emit, with the speaker, the first anti-noise signal;

receive, with the feedback microphone at a second time, the external noise and the first anti-noise signal, the second time being after the first time;

generate, with one or more processors, the filtered anti-noise signal based on the first anti-noise signal and the external noise received by the feedback microphone at the second time; and emit, with the speaker, the filtered anti-noise signal.

13. A method, comprising:

receiving, with a feedforward microphone at a first time, external noise outside of a housing of an earbud;

generating, with the one or more processors, a first anti-noise signal based on the external noise received by the feedforward microphone;

emitting, with a speaker, the first anti-noise signal;

receiving, with a feedback microphone at a second time, the external noise and the first anti-noise signal, the second time being after the first time, the housing comprising a duct that imparts a time delay to the external noise received at the feedback microphone;

generating, with one or more processors, a filtered anti-noise signal based on the first anti-noise signal and the external noise received by the feedback microphone at the second time; and emitting, with the speaker, the filtered anti-noise signal.

14. The method of claim 13, wherein, at the second time, the feedback microphone receives the external noise having a lower amplitude than the external noise received by the feedforward microphone at the first time.

15. The method of claim 13, further comprising comparing the external noise received from the feedback microphone and the first anti-noise signal to determine whether the first anti-noise signal covers a frequency range of the external noise.

16. A non-transitory computer-readable medium housed in a computing device storing instructions, which when executed by one or more processors, cause the one or more processors to:

receive, with a feedforward microphone at a first time, external noise outside of a housing of an earbud;

generate, with the one or more processors, a first anti-noise signal based on the external noise received by the feedforward microphone;

emitting, with a speaker, the first anti-noise signal;

receiving, with a feedback microphone at a second time, the external noise and the first anti-noise signal, the second time being after the first time, the housing comprising a duct that imparts a time delay to the external noise received at the feedback microphone;

generating, with one or more processors, a filtered anti-noise signal based on the first anti-noise signal and the external noise received by the feedback microphone at the second time; and emitting, with the speaker, the filtered anti-noise signal.

17. The non-transitory computer-readable medium of claim 16, wherein, at the second time, the feedback microphone receives the external noise having a lower amplitude than the external noise received by the feedforward microphone at the first time.

18. The non-transitory computer-readable medium of claim 16, further comprising comparing the external noise received from the feedback microphone and the first anti-noise signal to determine whether the first anti-noise signal covers a frequency range of the external noise.

* * * * *